US010722025B2

(12) United States Patent
Flores

(10) Patent No.: US 10,722,025 B2
(45) Date of Patent: Jul. 28, 2020

(54) MULTIPURPOSE PORTABLE TABLE

(71) Applicant: Tabletop Gear, LLC, Tampa, FL (US)

(72) Inventor: David Michael Flores, Temple Terrace, FL (US)

(73) Assignee: TABLETOP GEAR, LLC, Tampa, FL (US)

( * ) Notice: Subject to any disclaimer, the term of this patent is extended or adjusted under 35 U.S.C. 154(b) by 0 days.

(21) Appl. No.: 16/270,689

(22) Filed: Feb. 8, 2019

(65) Prior Publication Data

US 2019/0246787 A1 Aug. 15, 2019

Related U.S. Application Data

(60) Provisional application No. 62/628,328, filed on Feb. 9, 2018.

(51) Int. Cl.

| | |
|---|---|
| ***A47B 3/06*** | (2006.01) |
| ***A47B 13/02*** | (2006.01) |
| ***A47B 13/00*** | (2006.01) |
| ***A45F 3/44*** | (2006.01) |
| ***A47B 13/16*** | (2006.01) |
| ***A47B 13/06*** | (2006.01) |
| ***A47B 37/04*** | (2006.01) |

(52) U.S. Cl.

CPC ..... *A47B 3/06* (2013.01); *A45F 3/44* (2013.01); *A47B 13/003* (2013.01); *A47B 13/023* (2013.01); *A47B 13/06* (2013.01); *A47B 13/16* (2013.01); *A47B 37/04* (2013.01); *A47B 2200/0021* (2013.01)

(58) Field of Classification Search

CPC ..... A47B 13/023; A47B 2200/0021; E04H 12/2215

USPC ..... 108/150, 157.1; 248/530

See application file for complete search history.

(56) References Cited

U.S. PATENT DOCUMENTS

| | | | | | |
|---|---|---|---|---|---|
| 181,826 | A * | 9/1876 | Eanes | E04H 12/2215 | 248/156 |
| 798,945 | A * | 9/1905 | Berntson | E04H 12/2215 | 52/154 |
| 1,218,357 | A * | 3/1917 | Bauer | A47B 3/12 | 108/158 |
| 2,877,828 | A * | 3/1959 | Barnette, Jr. | A01K 97/10 | 248/533 |
| 4,920,897 | A * | 5/1990 | Reed | A47B 37/04 | 108/150 |
| 5,152,495 | A * | 10/1992 | Jacinto | E04H 12/2223 | 135/98 |
| 5,396,743 | A * | 3/1995 | Bellette | E04H 12/2215 | 135/118 |
| 5,568,785 | A * | 10/1996 | Hazen | E04H 12/2215 | 116/209 |
| 6,487,977 | B1 * | 12/2002 | Williams | A45B 23/00 | 108/150 |

(Continued)

*Primary Examiner* — Jose V Chen

(74) *Attorney, Agent, or Firm* — Shumaker, Loop & Kendrick, LLP

(57) ABSTRACT

Disclosed is a portable table assembly having a table top, a solid elongate cylindrical stem that receives and carries the table top. The portable table assembly is easily assembled and adaptable for a wide variety of uses including, but not limited to, outdoor/lawn gaming, parks and general recreation, outdoor sporting and concert events, tailgate parties, camping, gardening, and beach use (with or without a beach umbrella).

10 Claims, 12 Drawing Sheets

(56) References Cited

U.S. PATENT DOCUMENTS

| | | | | |
|---|---|---|---|---|
| 6,705,240 | B2 * | 3/2004 | Block | A47B 13/023 108/150 |
| 6,732,985 | B1 * | 5/2004 | Cantrell | A45F 3/44 248/125.1 |
| 6,908,067 | B2 * | 6/2005 | Clasen | E04H 12/2223 248/533 |
| 6,925,754 | B1 * | 8/2005 | Tearoe | A01G 9/12 172/371 |
| 9,220,337 | B1 * | 12/2015 | Wenzel | A47B 13/021 |
| 9,380,861 | B1 * | 7/2016 | Newman | A47B 37/04 |
| 9,554,630 | B1 * | 1/2017 | Patel | A45B 25/02 |
| 10,077,893 | B1 * | 9/2018 | Abraham | F21V 33/0052 |
| D858,160 | S * | 9/2019 | Flores | D6/691.6 |
| 2004/0206860 | A1 * | 10/2004 | Bolinder | E04H 12/2215 248/156 |
| 2005/0178300 | A1 * | 8/2005 | Garfunkle | A47B 13/023 108/150 |
| 2008/0196636 | A1 * | 8/2008 | Lawrence | A47B 3/12 108/150 |
| 2012/0132113 | A1 * | 5/2012 | Unger | A47B 3/12 108/28 |
| 2014/0102337 | A1 * | 4/2014 | Ralph | A47B 37/04 108/25 |
| 2015/0208634 | A1 * | 7/2015 | Box | A01K 97/10 108/25 |
| 2017/0042321 | A1 * | 2/2017 | Clause | A47B 13/003 |
| 2017/0127824 | A1 * | 5/2017 | Schneider | A47B 3/06 |
| 2018/0271273 | A1 * | 9/2018 | Miller | A47B 37/04 |

* cited by examiner

MULTIPURPOSE PORTABLE TABLE

TECHNICAL FIELD

The present invention relates generally to the field of tables, and more particularly, to multipurpose portable tables configured for outdoor use that are easily assembled and disassembled.

BACKGROUND

Current tables and table tops are restricted to either indoor or outdoor uses and have very little versatility. For example, certain existing tables and table tops have restricted portability due to their size and/or weight. Most of the currently existing portable table tops have permanently attached, collapsible/foldable legs, but are incapable of being disassembled for transport purposes. Alternatively and when configured for disassembly, existing portable tables are difficult to disassemble often requiring tools for disassembly as well as a prolonged time period for doing so. Furthermore, many of these portable table tops are not readily adaptable for different activities including, but not limited to, patio/porch use, outdoor/lawn gaming, parks and general recreation, outdoor sporting and concert events, tailgate parties, camping, gardening, and beach use.

Therefore a need exists to provide table(s) and table assemblies that overcome the limitations of the above mentioned portable tables and table tops and that allows for an entire variety of uses including at least, but not limited to, patio/porch use, outdoor/lawn gaming, parks and general recreation outdoor sporting and concert events, tailgate parties, camping, gardening, and beach use.

SUMMARY

Disclosed herein are tables and table assemblies that overcome the limitations known in the art, allowing for a wide variety of uses including at least, but not limited to, patio/porch use, outdoor/lawn gaming, parks and general recreation, outdoor sporting and concert events, tailgate parties, camping, gardening, and beach use. Specifically disclosed are portable tables and portable table assemblies including an elongate cylindrical stem; a table top having an opening in the middle of the table top that is adapted to receive the elongate cylindrical stem therethrough such that the hollow cylindrical stem extends above and below the table top when inserted in the opening; and a mounting bracket assembly that is fastened to the bottom surface of the table top. The mounting bracket assembly has a hollow cylindrical stem that has a larger inner diameter than the outer diameter of the elongate cylindrical stem. The hollow cylindrical stem receives the elongate cylindrical stem therethrough and includes fastener(s) that fasten the mounting bracket assembly and table top to the elongate cylindrical stem thereby securing the table top to the elongate cylindrical stem. In certain aspects, the assembly may include an enclosed elongate cylindrical stem that is hollow on its interior. The enclosed elongate cylindrical stem functions in substantially the same manner as the elongate cylindrical stem but is internally hollow when overall weight reduction of the assembly is desired.

In certain aspects disclosed is a portable table assembly including (a) a table top having an upper planar surface for placing items thereon; (b) an elongate cylindrical stem having a first end portion and a second end portion that are spaced apart from one another with first end portion configured to securely fasten the table top thereon and the second end portion configured to stably anchor the portable table assembly into a ground surface; and (c) a fastening arrangement that securely and removably fastens the table top to the first end portion of the elongate cylindrical stem thereby preventing rotation of the table top about a longitudinal axis of the elongate cylindrical stem.

In certain aspects, the table top includes an opening positioned in a middle of the table top that is adapted to axially align with and receive a distal end of the elongate cylindrical stem therethrough such that portions of the first end portion of the elongate cylindrical stem extend above and below upper and lower planar surfaces of the table top.

In certain aspects, the fastening arrangement includes a flange configured to carry the table top thereon when assembled, the flange positioned on the first end portion of the elongate cylindrical stem that is adjacent to and beneath the distal end of the elongate cylindrical stem.

In certain aspects, the fastening arrangement further includes a fastener configured to engage the distal end of the elongate cylindrical stem to secure the table top between the fastener and flange.

In certain aspects, the fastener and distal end of the elongate cylindrical stem threadedly engage one another.

In certain aspects, the flange is an annular flange circumferentially extending from a main body of the elongate cylindrical stem; the distal end of the elongate cylindrical stem has an externally threaded outer diameter; and the fastener has an internally threaded inner diameter configured to axially align with and engage the distal end of the elongate cylindrical stem and to advance on the distal end of the elongate cylindrical stem in a direction towards the annular flange to securely fasten the table top between the annular flange and fastener.

In certain aspects, the second end portion of the elongate cylindrical stem has a forked configuration.

In certain aspects, the forked configuration is trident shaped formed by a plurality of arms that include a main arm continuously formed on and extending along the same, longitudinal axis as the main body of the elongate cylindrical stem, and two side arms that are spaced apart from but are laterally adjacent to the main body and main arm of the elongate cylindrical stem, with each side arm extending along a parallel axis relative to the longitudinal axis of the main body of the elongate cylindrical stem and in a direction away from the first end of the elongate cylindrical stem.

In certain aspects, each arm of the plurality of arms of the forked configuration terminates with a pointed end configured to pierce a ground surface.

In certain aspects, each side arm of the fork configuration is shorter than the main arm of the fork configuration to provide lateral stability to the portable table assembly when anchoring the elongate cylindrical stem into a ground surface.

In certain aspects, utility hooks are positioned on the elongate cylindrical stem between the first and second end portions of the elongate cylindrical stem, with the utility hooks being more proximate to the first end portion than the second end portion of the elongate cylindrical stem.

In certain aspects, the assemblies include a clip having the fastener positioned therein with the fastener being partially concealed between two arms of the clip and the two arms being biased towards one another to securely receive and hold items therein when the table assembly is assembled.

In certain aspects, the fastening arrangement includes a mounting bracket affixed to a bottom planar surface of the table top, the mounting bracket includes a hollow cylindrical stem with arcuate grooves formed thereon, with the hollow cylindrical stem adapted to fit over the first end portion of the elongate cylindrical stem with the arcuate grooves engaging utility hooks positioned on the elongate cylindrical stem to prevent rotational movement of the table top about the longitudinal axis of the elongate cylindrical stem.

In certain aspects, the fastener positioned is in an opening of the hollow cylindrical stem that is configured to urge the elongate cylindrical stem in a direction of an inner wall of the hollow cylindrical stem opposite the opening to affix the position of the elongate cylindrical stem relative to the hollow cylindrical stem and table top.

In certain aspects, the assemblies include a driving member that is proximate to the second end portion and includes a lip configured for a user to apply downward force thereto to anchor the elongate cylindrical stem into a ground surface.

Embodiments of the invention can include one or more or any combination of the above features and configurations.

Additional features, aspects and advantages of the invention will be set forth in the detailed description which follows, and in part will be readily apparent to those skilled in the art from that description or recognized by practicing the invention as described herein. It is to be understood that both the foregoing general description and the following detailed description present various embodiments of the invention, and are intended to provide an overview or framework for understanding the nature and character of the invention as it is claimed. The accompanying drawings are included to provide a further understanding of the invention, and are incorporated in and constitute a part of this specification.

BRIEF DESCRIPTION OF THE DRAWINGS

These and Other Features, Aspects and Advantages of the Present Invention are Better Understood when the Following Detailed Description of the Invention is Read with Reference to the Accompanying Drawings, in which.

DETAILED DESCRIPTION

The present invention will now be described more fully hereinafter with reference to the accompanying drawings in which exemplary embodiments of the invention are shown. However, the invention may be embodied in many different forms and should not be construed as limited to the representative embodiments set forth herein. The exemplary embodiments are provided so that this disclosure will be both thorough and complete, and will fully convey the scope of the invention and enable one of ordinary skill in the art to make, use and practice the invention. Like reference numbers refer to like elements throughout the various drawings.

Figure 1:
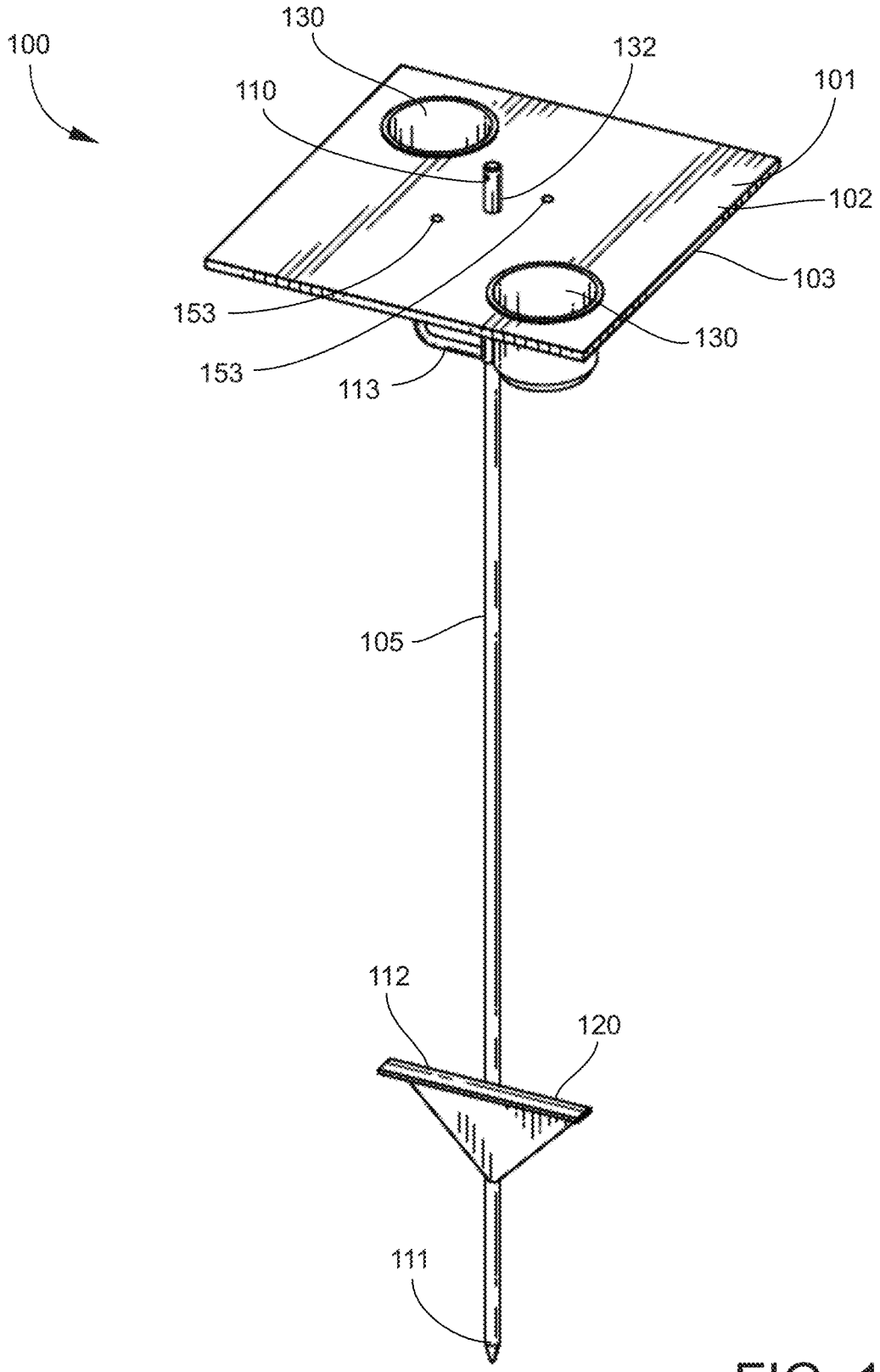
FIG. 1 is a perspective view of the portable table assembly according to a first embodiment.

FIGS. 1-8 and FIGS. 9-16 respectively depict a first and second embodiment of the portable table assemblies 100, 200 disclosed herein. In view of FIGS. 1-8, disclosed is a portable table assembly 100 having a table top 101 and an elongate cylindrical stem 105 (either a solid cylindrical stem or a hollow cylindrical stem) carrying the table top thereon. FIG. 1 depicts a perspective view of the portable table assembly 100 in which the tabletop 101 is secured to and carried on the elongate cylindrical stem 105.

As shown in FIGS. 1-5, the elongate cylindrical stem 105 has a first end portion 110 and a second end portion 111 that are spaced apart and positioned at opposite ends of the elongate cylindrical stem. The first end portion 110 is a solid (or enclosed), blunt end extending above the table top 101 while the second end portion 111 is a solid pointed/sharp end (or enclosed pointed/sharp end) for being driven into the ground and/or piercing ground surfaces to anchor the portable table assembly 100 when in use.

The elongate cylindrical stem 105 further includes a driving member 112 attached thereon in which the driving member is proximate to the second end portion 111 (when compared to the proximity to the first end portion 110) and includes a flat, planar lip 120 that is transverse to the longitudinal axis of the elongate cylindrical stem 105. The driving member and, more particularly, the flat, planar lip 120 extends beyond the peripheral edges of the elongate cylindrical stem 105. When assembled, a user may apply downward force to the driving member 112 and more particularly to flat, planar lip 120 to aid with the second end portion 111 piercing/being driven into the ground. The driving member 112 may have a predetermined desired shape. For example, in certain aspects, the driving member 112 may have a triangle or square shape. The elongate cylindrical stem 105 further includes utility hooks 113 that are integrally formed on and extend away from the elongate cylindrical stem. The utility hooks 113 are proximate to the first end portion 110 of the elongate cylindrical stem 105 when compared to its relative proximity to the second end portion 111. Portions of the utility hooks are transverse to the longitudinal axis of the elongate cylindrical stem 105 but are substantially parallel relative to the flat lip 120 of the driving member. The utility hooks 113 further include hooked end portions that curve upward, extending in a direction away from the driving member 112 towards the first end 110 of the elongate cylindrical stem (and table top 101 when present).

Utility hooks 113 aids in securing personal items to the portable table assembly when placed by a user thereon. In certain aspects, utility hooks 113 may include desired indicia placed thereon (e.g., advertising and/or personalized stickers, engraving) or may carry a banner thereon.

Figure 8:
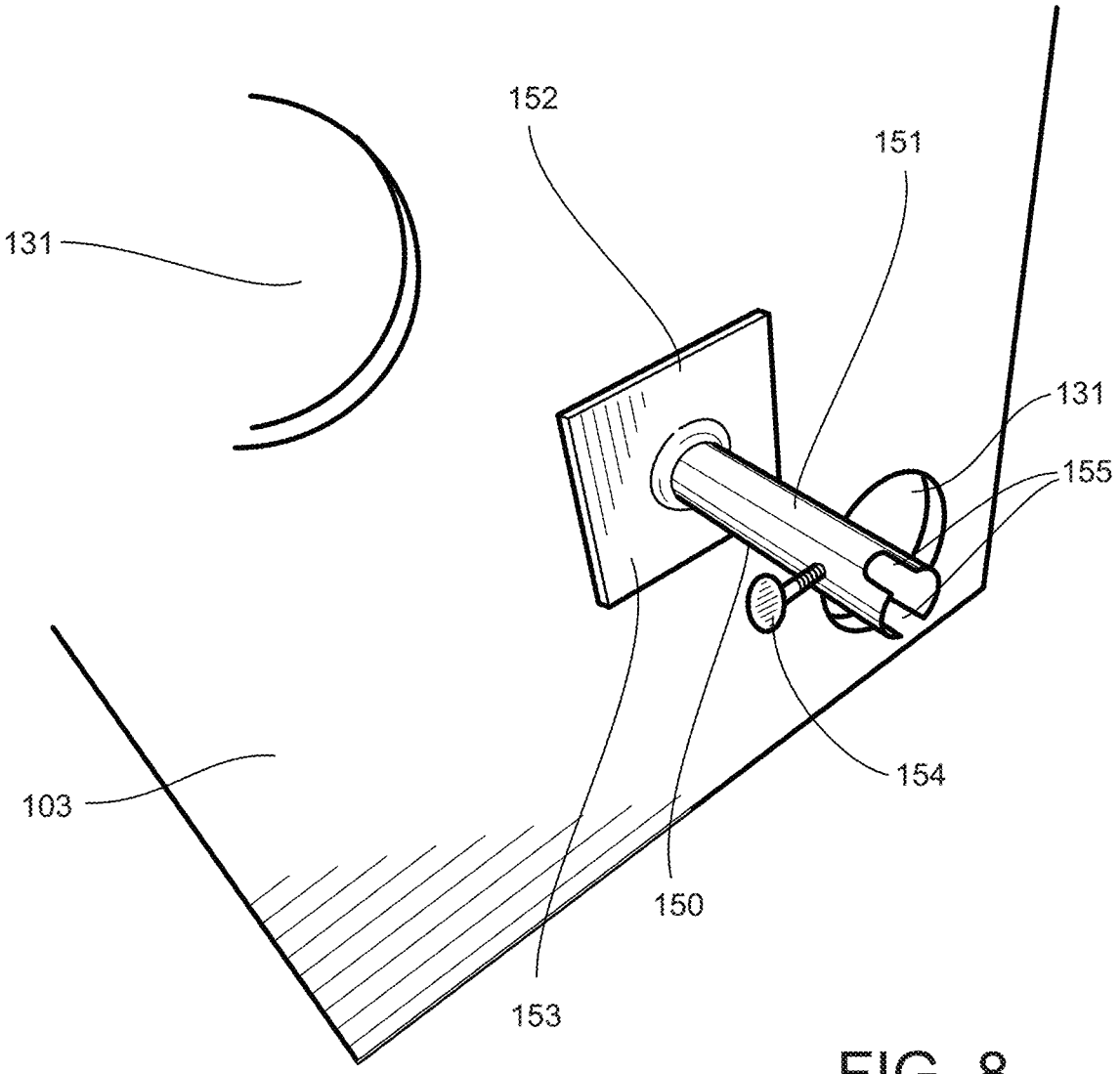
FIG. 8 is a bottom perspective view of the mounting bracket assembly according to a first embodiment fastened to the bottom surface of the portable table top assembly and further showing the arcuate grooves formed on the hollow cylindrical stem of the mounting bracket assembly.

As further shown in FIGS. 1-5, table top 101 has a predetermined shape (e.g., square, rectangular, triangular, circular, or oval shaped) with a top surface 102 that is substantially planar and is used for placing personal items thereon. Table top 101 further has a bottom surface 103 that is also substantially planar. In certain aspects, table top 101 has a plurality of openings that serve various purposes. For example, and as shown in FIG. 1, opening 132 is positioned substantially in the middle of the table top 101 and extends from the bottom surface 103 of the table top to the top surface 102 of the table top. As disclosed in greater detail below, opening 132 receives the elongate cylindrical stem 105 therethrough. As another example of the table top's openings, openings 131 (as shown in FIG. 8) are positioned adjacent to the peripheral edges of the table top 101 and receive storage compartments 130 therethrough. The storage compartments 130 can include rigid, removable cupholders, rigid, fixed cupholders, or flexible pouches fixed to the table top 101 that further extend below the table top's bottom surface 103, which may be used for storage. Additional openings, which serve as through holes, are positioned throughout the table top and, as described in further detail below, are configured to receive the mounting bracket fasteners 153 therethrough.

Figure 2:
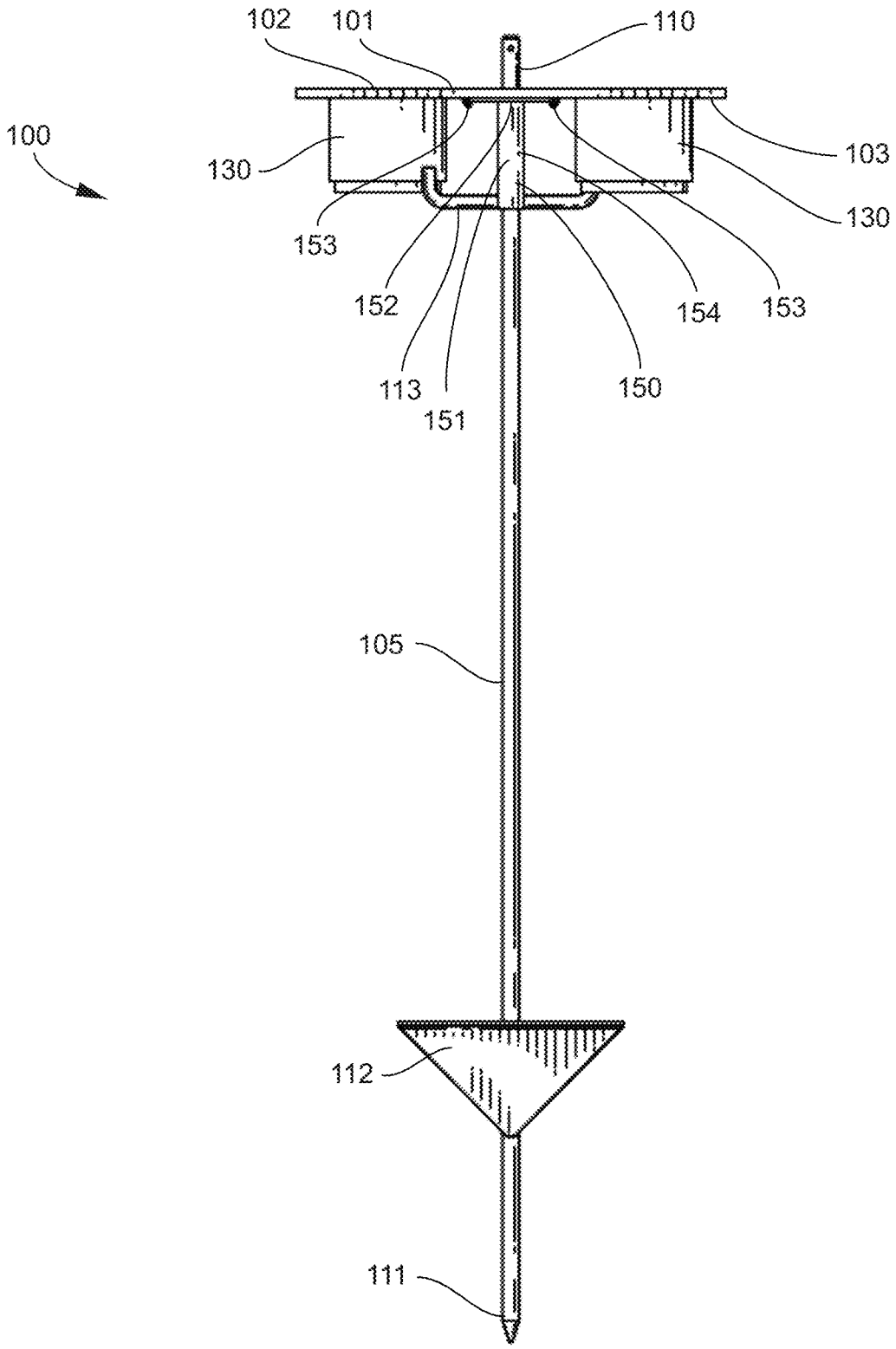
FIG. 2 is a front view of the portable table assembly according to a first embodiment.
Figure 3:
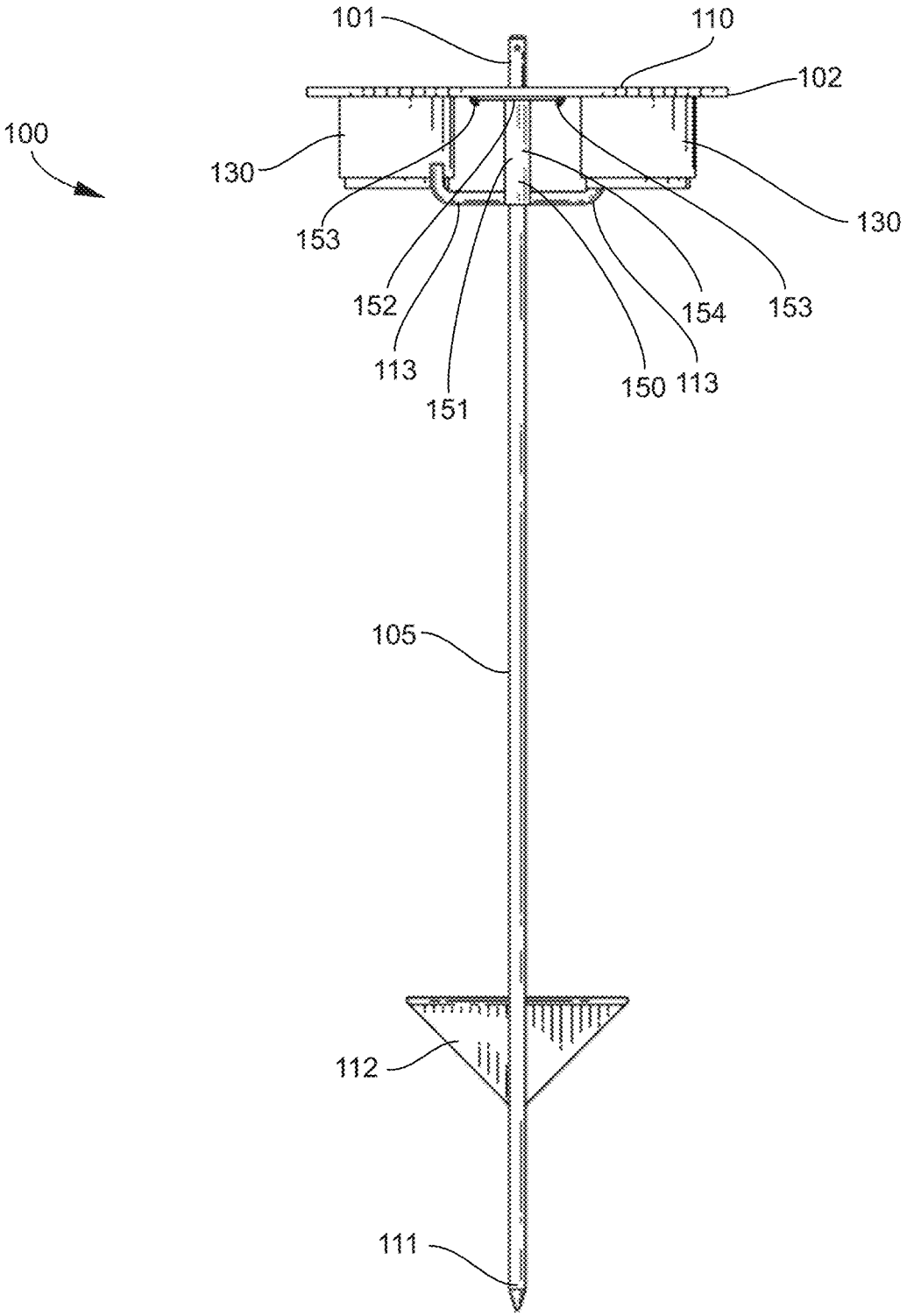
FIG. 3 is a back view of the portable table assembly according to a first embodiment.
Figure 4:
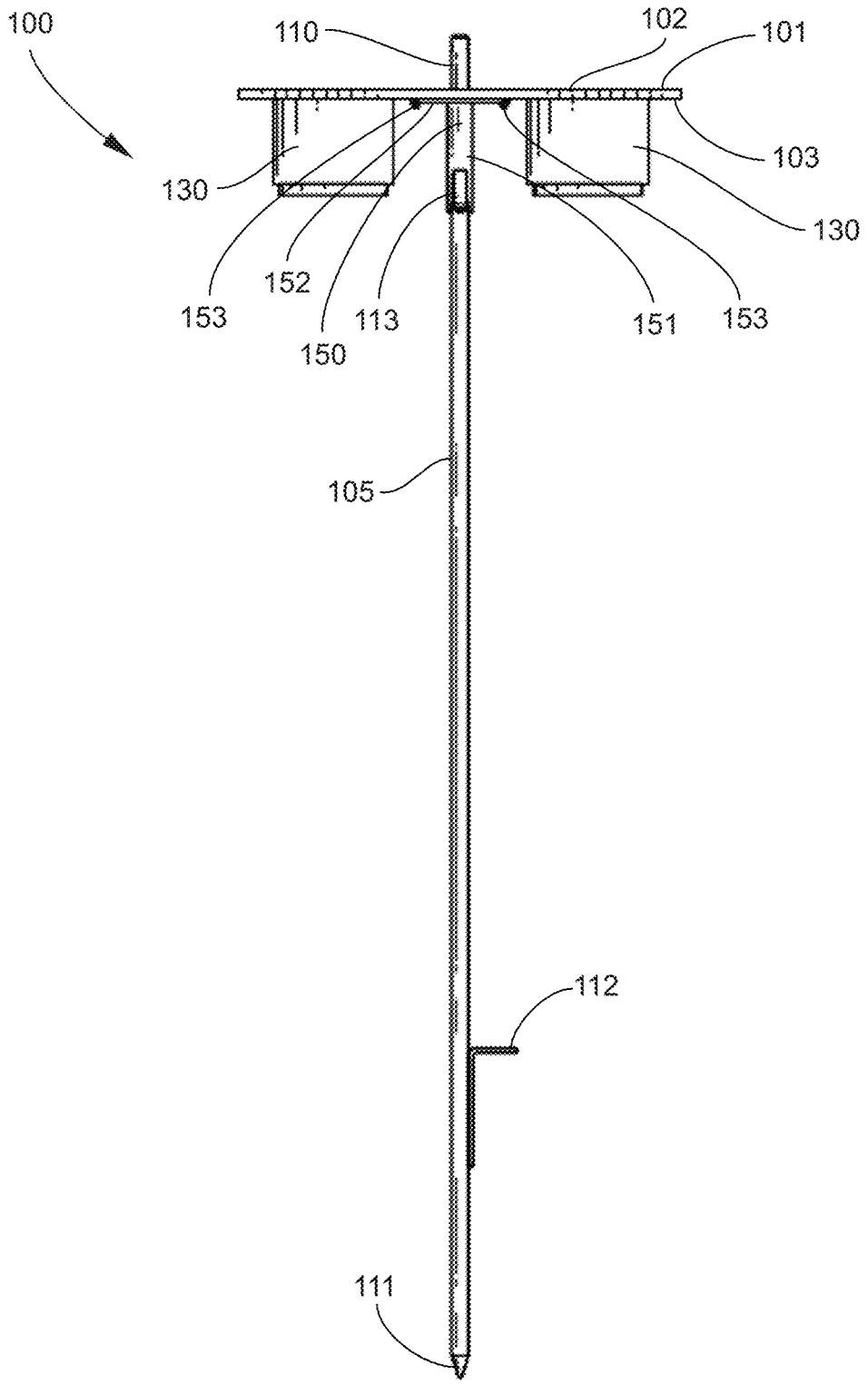
FIG. 4 is a left side view of the portable table assembly according to a first embodiment.
Figure 5:
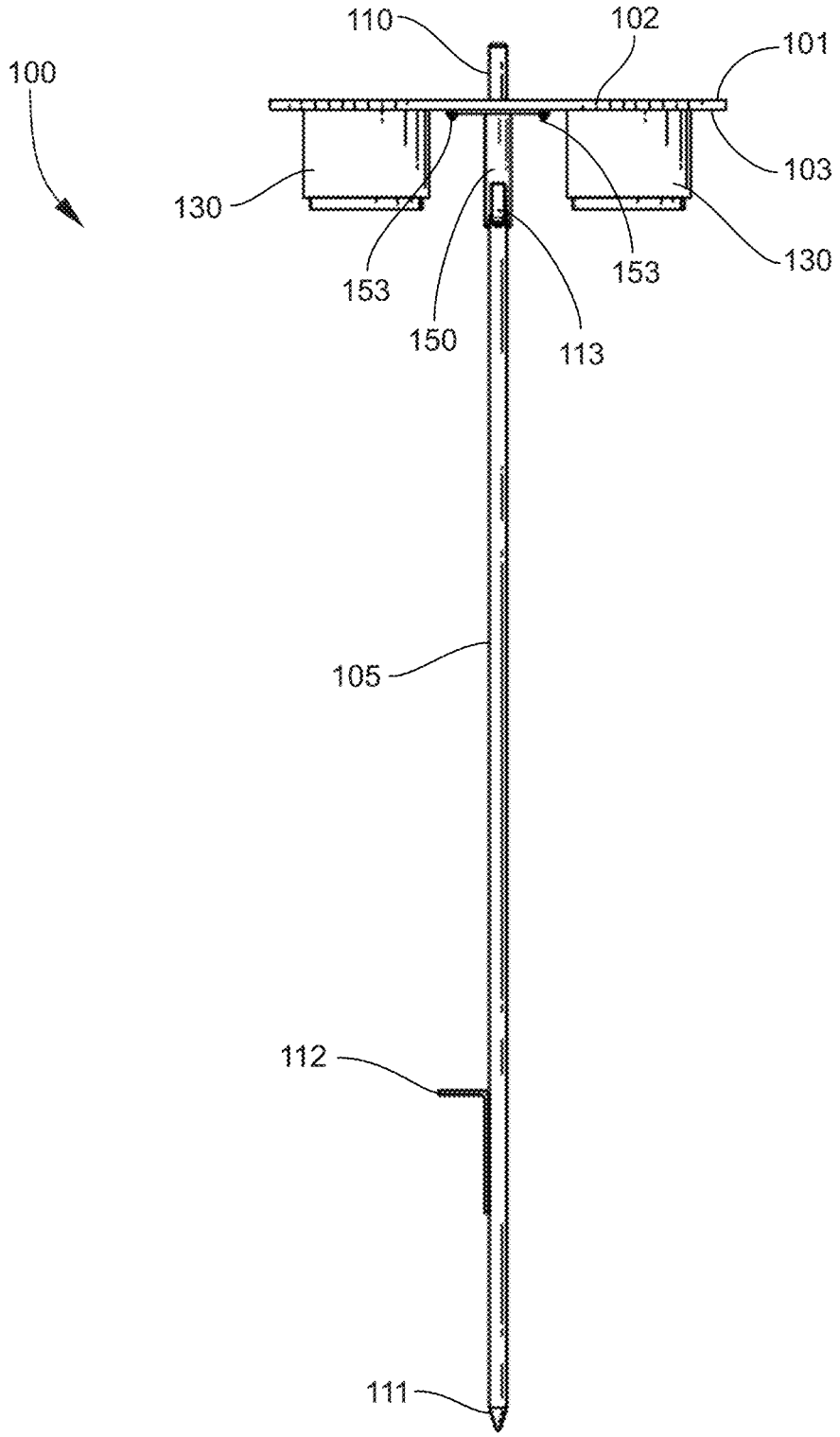
FIG. 5 is a right side view of the portable table assembly according to a first embodiment, which is a mirror image of the left side view depicted in FIG. 4.
Figure 6:
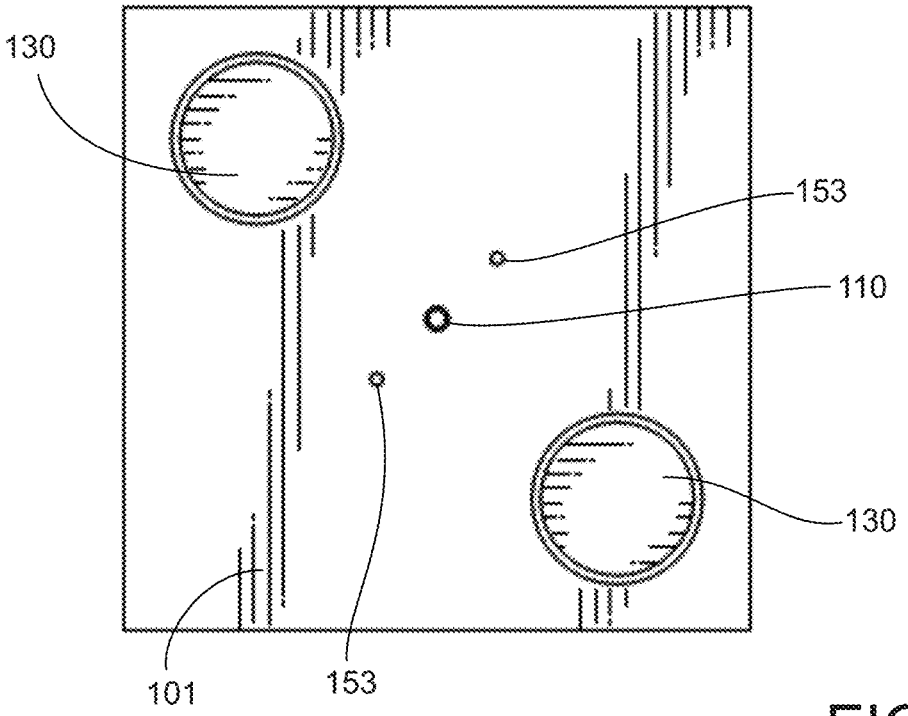
FIG. 6 is a top view of the portable table assembly according to a first embodiment.
Figure 7:
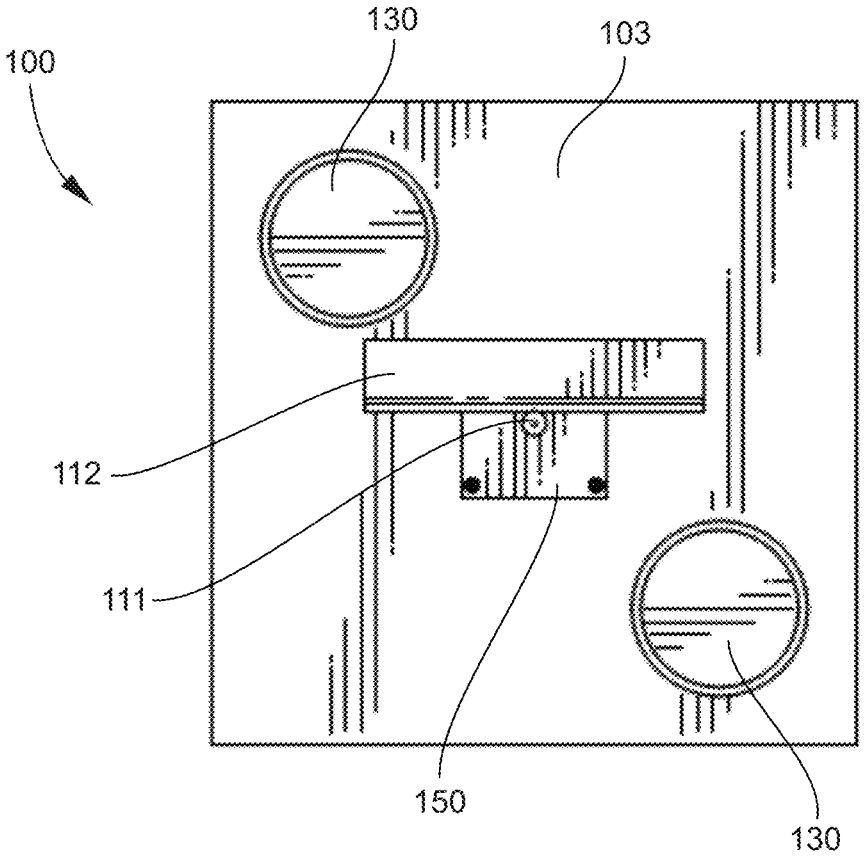
FIG. 7 is a bottom view of the portable table assembly according to a first embodiment.

FIG. 8 depicts the mounting bracket assembly 150 that is configured to secure the table top 101 to the elongate cylindrical stem 105 (as shown, for example, in FIG. 2). Specifically, mounting bracket assembly 150 shown in FIG. 8 includes a hollow cylindrical stem 151, a flat plate 152 attached to one end of the hollow cylindrical stem, and a pair of arcuate grooves 155 positioned on the opposite end of the hollow cylindrical stem relative to the flat plate. The mounting bracket assembly 150 further includes a plurality of through holes that receive fasteners 153, 154 therethrough, which fasten the table top 101 to the mounting bracket assembly 150 and the mounting bracket assembly 150 to the elongate cylindrical stem 105 respectively. As specifically shown in FIG. 8, fasteners 153 fasten the flat plate 152 of the mounting bracket assembly 150 to the bottom surface 103 of the table top 101.

When the mounting bracket assembly 150 (and more specifically flat plate 152) is fastened to the bottom surface of the bottom surface 103 of the table top 101 and when assembling the portable table assembly 100, the hollow cylindrical stem 151 axially aligns with opening 132 of the table top 101 (as shown in FIG. 1) such that the first end portion 110 of the elongate cylindrical stem 105 can be received through both the hollow cylindrical stem 151 and opening 132 such that the first end portion 110 extends above the top surface 102 of the table top 101. In other words, the elongate cylindrical stem 105 and the hollow cylindrical stem 151 can be fitted to one another such that the table top 101 may be moved in a linear fashion along the elongate cylindrical stem 105 when the hollow cylindrical stem (and table top) is fitted thereon.

When securing the table top 101 to the elongate cylindrical stem 105, the arcuate grooves 155 of the mounting bracket assembly 150 engage and are carried on upper portions of the utility hooks 113 that are substantially parallel to flat lip 120 of the driving member. The arcuate grooves 155 vertically engage the utility hooks 113 and function to limit horizontal movement of the table top 101 when engaged with the elongate cylindrical stem 105. In certain aspects, the edges of the arcuate grooves 155 may be lined or coated with a resiliently deformable elastomeric material that imparts friction (e.g., friction fit) when the arcuate grooves engage the utility hooks 113 thereby further securing the table top 101 to the elongate cylindrical stem 105 and further limiting horizontal and vertical movement of the table top when engaged with the elongate cylindrical stem. As further shown in FIG. 8 and to further secure the table top 101 to the elongate cylindrical stem 105 and to further limit both horizontal and vertical movement of the table top while positioned on the elongate cylindrical stem 105, fastener 154 positioned in an opening of the hollow cylindrical stem 151 may be deployed. For example and as shown in FIG. 8 in view of FIG. 1, fastener 154 extends in a direction that is transverse to the longitudinal axis of both the elongate cylindrical stem 105 and the hollow cylindrical stem 151 of the mounting bracket assembly 150. When securing the elongate cylindrical stem 105 in the hollow cylindrical stem 151, the fastener is advanced through an opening in the hollow cylindrical stem 151 to contact the elongate cylindrical stem 105 and urge the elongate cylindrical stem in a direction of an inner wall of the hollow cylindrical stem 151 opposite the opening to secure and/or fix the position of the elongate cylindrical stem relative to the hollow cylindrical stem 151 and table top 101. As understood in view of the above disclosures, the table top 101, fastener 154, and elongate cylindrical stem arrangement 105 of the first embodiment provides for a quick assembly and disassembly of the portable table assembly 100 thereby allowing the user to easily use the portable table assembly 100 in a variety of environments.

Figure 9:
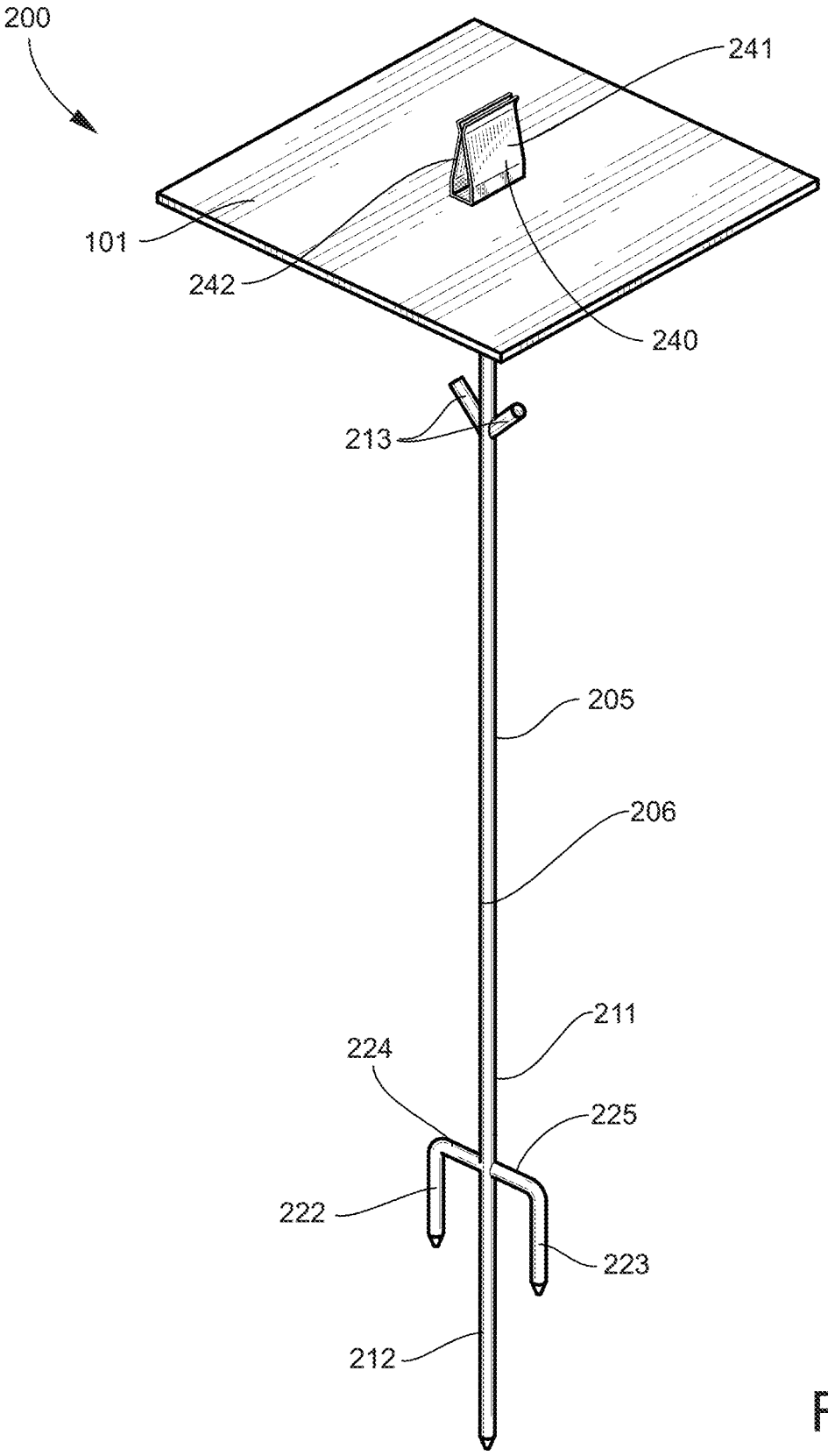
FIG. 9 is a perspective view of the portable table assembly according to a second embodiment.
Figure 10:
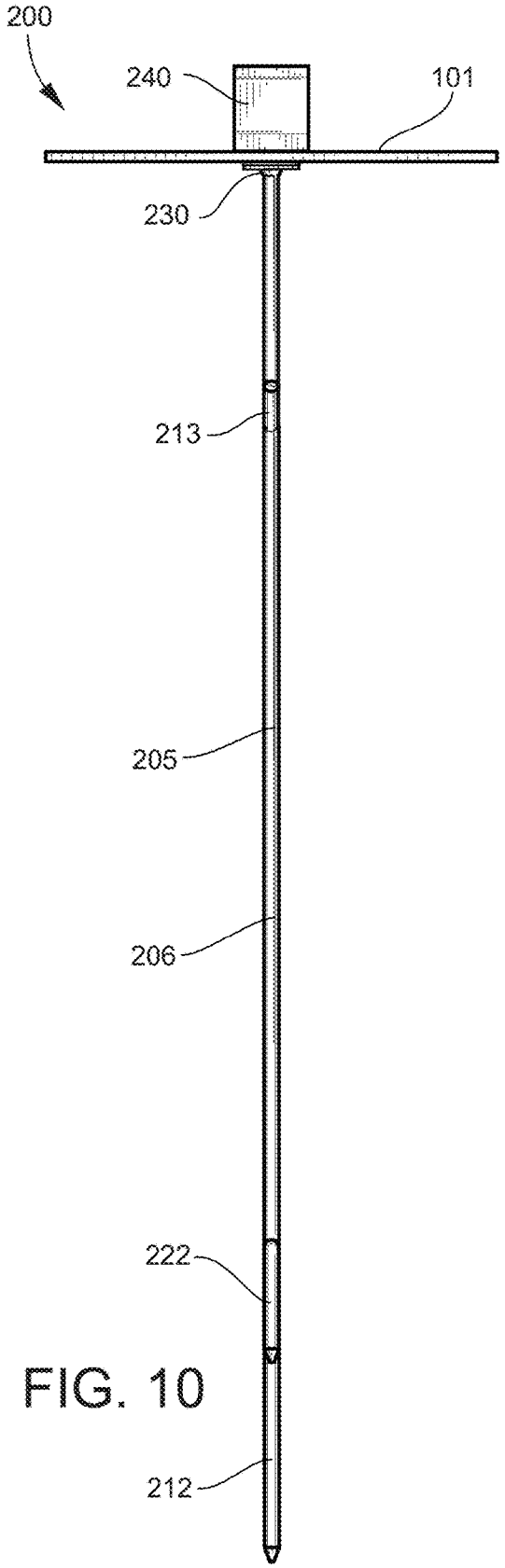
FIG. 10 is a left side view of the portable table assembly according to a second embodiment.
Figure 11:
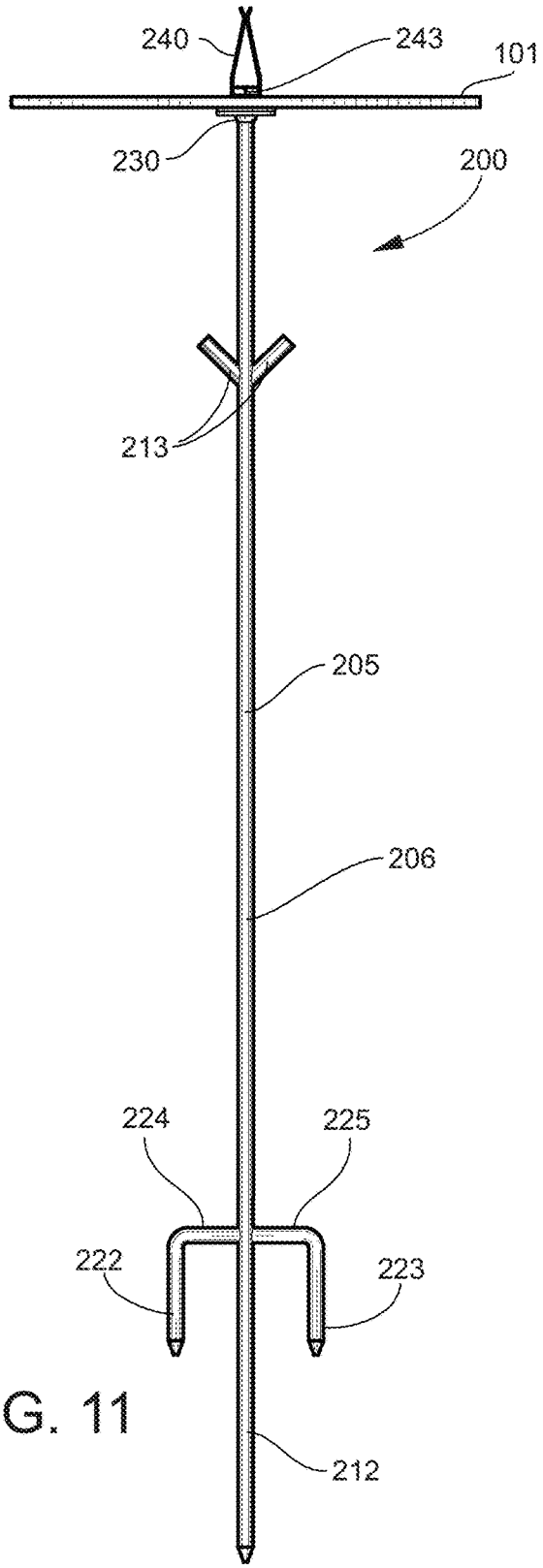
FIG. 11 is a front view of the portable table assembly according to a second embodiment.
Figure 12:
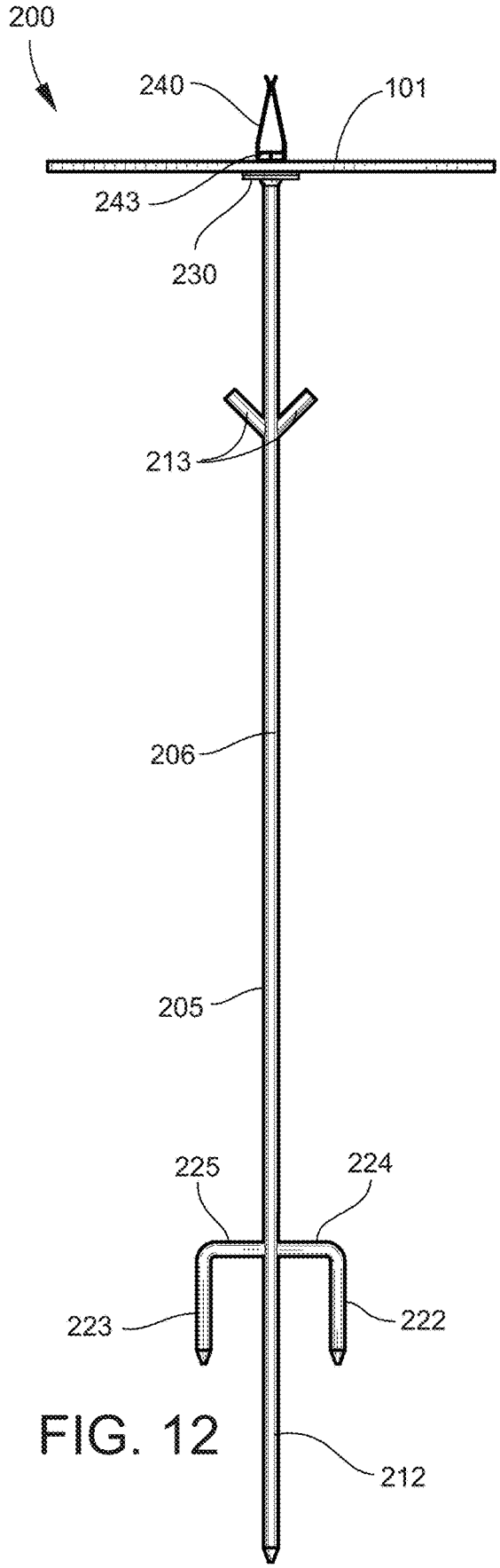
FIG. 12 is a back view of the portable table assembly according to a second embodiment.
Figure 13:
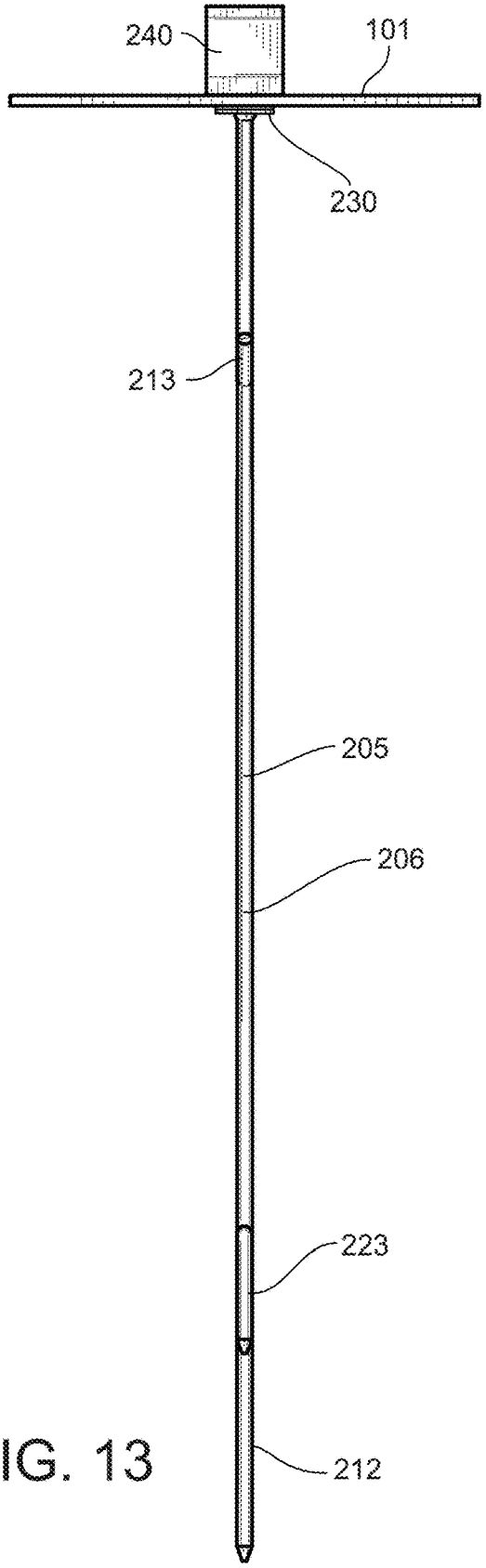
FIG. 13 is a right side view of the portable table assembly according to a second embodiment.
Figure 14:
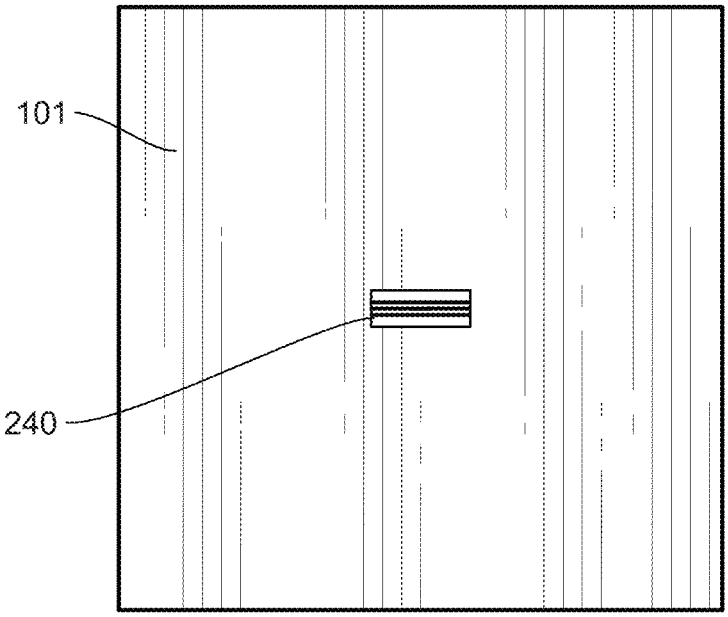
FIG. 14 is a top view of the portable table assembly according to a second embodiment.
Figure 15:
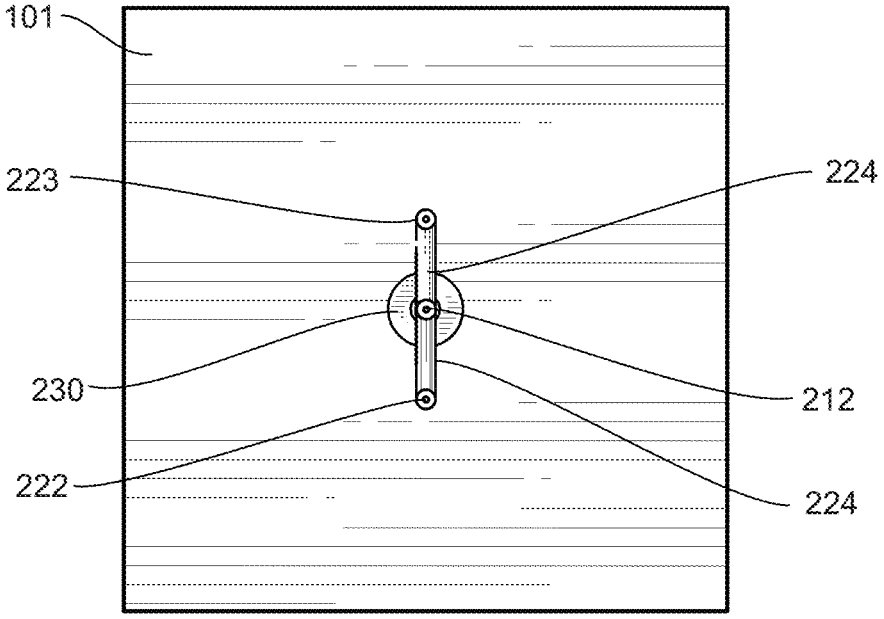
FIG. 15 is a bottom view of the portable table assembly according to a second embodiment.

Disclosed in FIGS. 9-16 is a second embodiment of the portable table assembly 200 having a table top 101 and an elongate cylindrical stem 205 (either a solid cylindrical stem or a hollow cylindrical stem) configured for carrying the table top thereon. FIG. 9 specifically depicts a perspective view of the portable table assembly 200 in which the tabletop 101 is secured to and carried on the elongate cylindrical stem 205. FIG. 14 depicts a top view of the portable table assembly 200 according to the second embodiment, and FIG. 15 is a bottom view of the portable table assembly 200.

As shown in FIGS. 9-13 and 16, the elongate cylindrical stem 205 has a first end portion 210 and a second end portion 211 that are spaced apart and positioned on opposite ends of the elongate cylindrical stem. As specifically shown in FIG. 16, the first end portion 210 includes a blunt end (solid, enclosed, and/or hollow blunt end) configured to extend above the table top 101 when assembled while the second end portion 211 is a pointed end (solid, enclosed, and/or hollow pointed end) configured for driving into/piercing and anchoring into ground surfaces when the portable table assembly 200 is in use.

As further shown in FIGS. 9-13 and 16 and instead of including the driving member disclosed in the first embodiment above, the elongate cylindrical stem 205 of the second embodiment further includes a forked configuration (e.g., a bipartite fork configuration or a tripartite/trident configuration) on the second end portion 211 for anchoring the elongate cylindrical stem 205 into a surface while the portable table assembly 200 is being assembled and/or in use. In certain aspects, a trident configuration is particularly preferred due to the stability that this configuration imparts when the elongate cylindrical stem 205 is anchored into a ground surface. The trident configuration is formed by plurality of arms 212, 222, 223, 224, 225 extending from the elongate cylindrical stem 205 and include a main arm 212 continuously formed on and extending along the same, longitudinal axis as the main body 206 of the elongate cylindrical stem 205. The trident configuration further includes two side arms 222, 223 that are spaced apart from but are laterally adjacent to the main body 206 and main arm 212 of the elongate cylindrical stem 205, with each side arm 222, 223 extending along a parallel/substantially parallel axis relative to the longitudinal axis of the main body 206 of the elongate cylindrical stem 205.

The trident configuration further includes connecting portions 224, 225 each having one end that is directly connected to and laterally extending directly from the main body 206 of the elongate cylindrical stem 205 and each having a second end directly connected to side arms 222, 223 respectively. As further depicted in, example FIGS. 9 and 16, the second ends of connecting portions are preferably curved to prevent and/or reduce the likelihood of user injury while handling and/or assembling portable table assembly 200. As further depicted in FIGS. 9-13 and 16, the connecting portions are angled (e.g., preferably perpendicular or substantially perpendicular) relative to the longitudinal axis of the main body 206 of elongate cylindrical stem 205 and provide a surface on which a user may apply force via a hand or foot to drive the cylindrical stem 205 into a ground surface to further anchor the elongate stem therein while the portable table assembly 200 is being assembled and/or in use.

In certain aspects and to further enhance anchoring capabilities and lateral stability of the elongate cylindrical stem 205, side arms 222, 223 are preferably shorter than main arm 212 and extend downward approximately mid-span and/or half the overall length of main arm 212. To further enhance anchoring capabilities of the elongate cylindrical stem 205, each arm 212, 222, 223 extends downwardly away from, for example, first end portion 210 and table top 101 (when assembled thereon) and terminates with a pointed/sharp end configured for piercing and anchoring the elongate cylindrical stem 205 into a ground surface.

As further shown in FIGS. 9-13 and 16, the elongate cylindrical stem 205 further includes utility hooks 213 that are integrally formed on the elongate cylindrical stem 205 and/or are attached to the elongate cylindrical stem. The utility hooks 213 are proximate to the first end portion 210 relative to the second end portion 211 of the elongate cylindrical stem 205. In view of the utility hooks in the first embodiment, the utility hooks 213 of the second embodiment are considerably shorter in overall length and are angled differently—with a linear, constant sloped gradient extending away from the second end portion 211 of elongate cylindrical stem 205 towards the first end portion 210 of elongate cylindrical stem 205 and table top 101 (when assembled).

As further shown in FIGS. 9-13 and 16, utility hooks 213 are further angled relative to and extend away from the connecting portions of the forked/trident configuration. Similar to the utility hooks in the first embodiment, the utility hooks 213 of the second embodiment aid in securing personal items to the portable table assembly when placed by a user thereon but further have sufficient clearance relative to the table top 101 such that items can easily be placed on and removed form utility hooks 213 as desired without any interference from table top 101 or cup holders (if present on table top). In certain aspects, utility hooks 213 may include desired indicia placed thereon (e.g., advertising and/or personalized stickers, engraving) or may carry a banner thereon.

Figure 16:
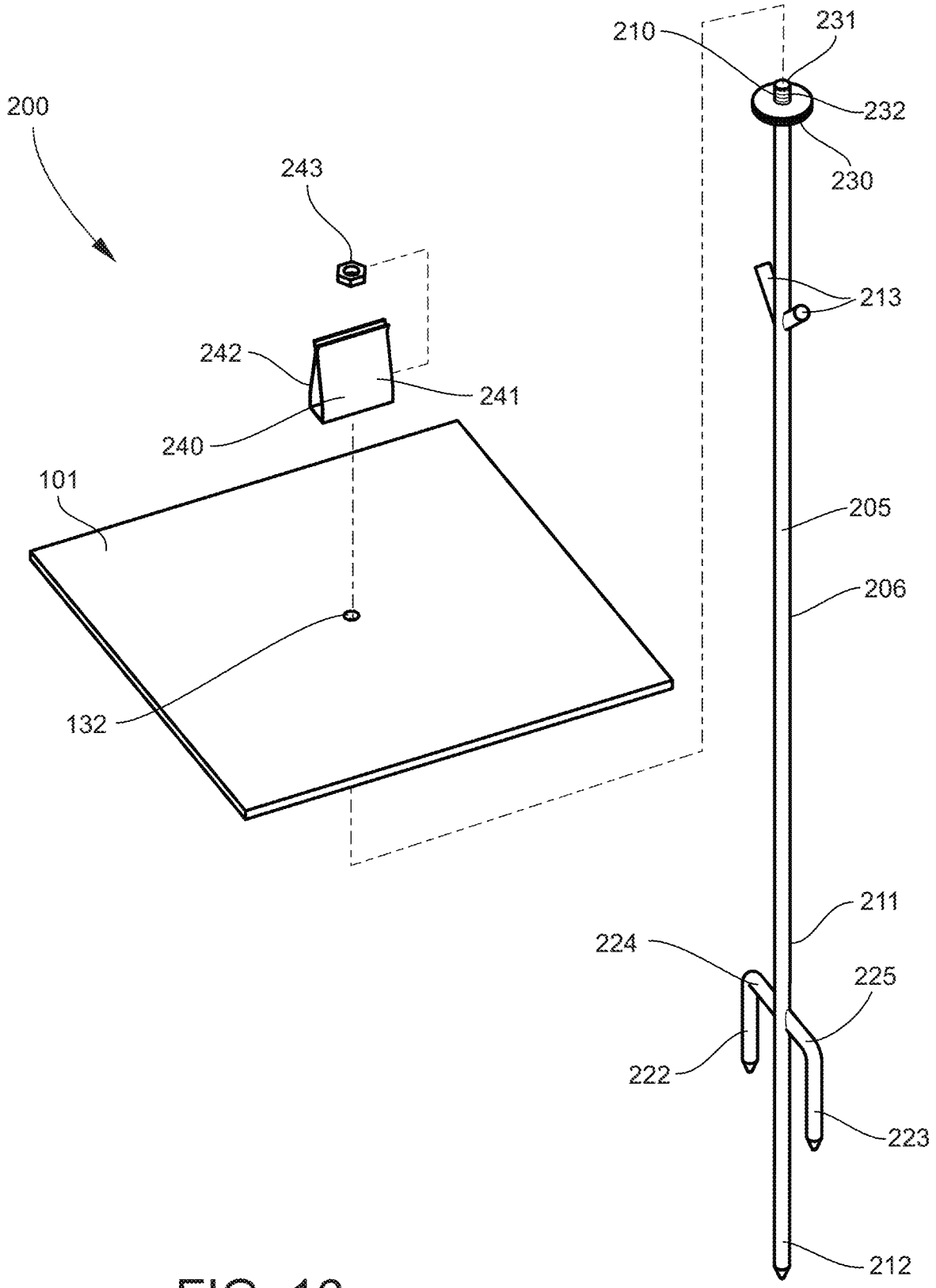
FIG. 16 is an exploded view of the portable table assembly according to a second embodiment.

As further shown in FIGS. 9-13 and 16, table top 101 has a predetermined shape (e.g., square, rectangular, triangular, circular, or oval shaped) with a top surface 102 that is substantially planar and is used for placing personal items thereon. Table top 101 further has a bottom surface 103 that is also substantially planar. In certain aspects, table top 101 has a plurality of openings that serve various purposes. For example, and as shown in FIG. 16, opening 132 is positioned substantially in the middle of the table top 101 and extends from the bottom surface 103 of the table top to the top surface 102 of the table top. As disclosed in greater detail below and as shown in FIG. 16 in view of FIG. 9, opening 132 is configured to axially align with and receive the first end portion 210 of the elongate cylindrical stem 205 therethrough. As another example of the table top's openings, openings (similar or identical to reference numeral 131 in the first embodiment) are positioned adjacent to the peripheral edges of the table top 101 and may receive storage compartments (e.g., similar or identical to 130 in the first embodiment) therethrough. The storage compartments can include rigid, removable cup holders, rigid, fixed cup holders, or flexible pouches fixed to the table top 101 that further extend below the table top's bottom surface 103, which may be used for storage.

Unlike the first embodiment, the second embodiment does not utilize a bracket assembly to affix the table top 101 to elongate cylindrical stem 205. Instead, the first end portion 210 utilizes a specific annular flange 230 and fastener arrangement to further simplify the second embodiment thus allowing a user to quickly and easily assemble and disassemble portable table assembly 200. With specific reference to FIG. 16, FIG. 16 depicts an exploded view of portable table assembly 200 according to the second embodiment disclosed herein. As shown in FIG. 16, an annular flange 230 is directly connected to and circumferentially extends away from the elongate cylindrical stem 205 and is further configured to receive the table top 101 thereon such that the table top 101 is carried by flange 230 and as discussed further below is secured thereto. As further shown in FIGS. 10-13 and 16, the annular flange 230 is positioned above utility hooks 213 on the cylindrical stem 205 such that the annular flange is more proximate to the distal end 231 of the first end portion 210 of the elongate cylindrical stem 205 than hooks 213.

FIG. 16 further depicts distal end 231 of the portable table assembly 200 according to a second embodiment. The distal end 231 is directly adjacent to and extends above annular flange 230 and further includes a threaded outer diameter 232 for engaging, for example, an internally threaded nut/fastener 243. As further shown in FIG. 16, the portable table assembly 200 includes nut/fastener 243 for fastening table top to the elongate cylindrical stem 205 by fastening the table top between annular flange 230 and nut/fastener 243. As further shown in FIG. 16, the portable table assembly 200 may further include a clip 240 (e.g., a butterfly clip) with the nut/fastener 243 seated/affixed to and partially concealed within clip 240. The clip further includes an opening axially aligned with an opening of the nut/fastener such that the nut/fastener 243 may engage distal end 231 of the elongate cylindrical stem 205 (as discussed further below). In certain aspects the clip, includes two arms 241, 242 that are biased towards one another and are configured to receive and securely hold various items (e.g., menus, papers, etc.) therein once the table assembly has been assembled.

FIG. 16 in view of FIG. 9 substantially depicts how to assemble and use the portable table assembly 200 according to the second embodiment. In essence, three parts are provided for assembly of the second embodiment that include: the elongate cylindrical stem 205, the table top 101, and the clip 240 with the nut/fastener 243 seated/affixed therein. When assembling the portable table assembly 200, the user may first drive the elongate cylindrical stem 205 into a ground surface (as previously described above) such that the stem is securely and stably anchored into the ground surface. Next, the user axially aligns opening 132 of the table top 101 over the distal end 231 of the elongate cylindrical stem and advances the distal end 231 through the opening 132 until table top 101 seats on and is carried by annular flange 230. At this point the table top is seated on the annular flange but may freely rotate about the longitudinal axis of the main body 206 of the elongate cylindrical stem 205 until securely attached thereto. To secure the table top 101 to the elongate cylindrical stem 205, next the nut/fastener 243 seated/affixed within clip 240 is axially aligned with distal end 231 of the cylindrical stem and internally threaded portions of the nut/fastener 243 are threaded with the externally threaded outer diameter 232 of the distal end 231 of the elongate cylindrical stem 205. The nut/fastener 243 is subsequently advanced along the externally threaded outer diameter 232 of the distal end 231 of the elongate cylindrical stem 205 towards the annular flange 230 until the nut/fastener 243 can no longer be rotated with the table top being securely fastened between the nut/fastener 243 seated/affixed within clip 240 and the annular flange 230. Alternatively, when assembling the portable table assembly 200, a user may initially assemble and secure the table top 101 to the elongate cylindrical stem 205 as described above before driving and anchoring the assembled portable table top assembly 200 into a ground surface. It should be further noted that in certain alternative embodiments the nut/fastener 243 may be used to securely fasten the table top 101 to the elongate cylindrical stem 205 while omitting clip 240.

In certain aspects, each of the embodiments may be prepackaged into kits.

The elongate cylindrical stem may be solid or may alternatively be hollow when overall weight reduction of the assembly is desired. In certain aspects, additional elongate stems having other predetermined shapes (e.g., rectangular, square, triangular, or oval shape) are contemplated and may be used instead of a cylindrical shape. In this aspect, table top opening 132 and various other applicable components disclosed herein would be varied to accommodate these other predetermined shapes if selected in lieu of the cylindrical shape(s) disclosed herein.

Applications for the disclosed table assembly may include, but are not limited to, patio/porch use, outdoor/lawn gaming, parks and general recreation, outdoor sporting and concert events, tailgate parties, camping, gardening, and beach use.

The foregoing description provides embodiments of the invention by way of example only. It is envisioned that other embodiments may perform similar functions and/or achieve similar results. Any and all such equivalent embodiments and examples are within the scope of the present invention and are intended to be covered by the appended claims.

What is claimed is:

1. A portable table assembly comprising:

(a) a table top having an upper planar surface for placing items thereon;

(b) an elongate cylindrical stem having a first end portion and a second end portion that are spaced apart from one another with first end portion configured to securely fasten the table top thereon and the second end portion configured to stably anchor the portable table assembly into a ground surface; and (c) a fastening arrangement that securely and removably fastens the table top to the first end portion of the elongate cylindrical stem thereby preventing rotation of the table top about a longitudinal axis of the elongate cylindrical stem, wherein:

the table top includes an opening positioned in a middle of the table top that is adapted to axially align with and receive a distal end of the elongate cylindrical stem therethrough such that portions of the first end portion of the elongate cylindrical stem extend above and below upper planar surface and lower surface of the table top;

the fastening arrangement includes a flange configured to carry the table top thereon when assembled and a fastener configured to threadedly engage the distal end of the elongate cylindrical stem to secure the table top between the fastener and the flange, the flange positioned on the first end portion of the elongate cylindrical stem that is adjacent to and beneath the distal end of the elongate cylindrical stem; and further comprising a clip having the fastener positioned therein with the fastener being partially concealed between two arms of the clip and the two arms being biased towards one another to securely receive and hold items therein when the table assembly is assembled.

2. The portable table assembly of claim 1, wherein the flange is an annular flange circumferentially extending from a main body of the elongate cylindrical stem;

the distal end of the elongate cylindrical stem has an externally threaded outer diameter; and the fastener has an internally threaded inner diameter configured to axially align with and engage the distal end of the elongate cylindrical stem and to advance on the distal end of the elongate cylindrical stem in a direction towards the annular flange to securely fasten the table top between the annular flange and fastener.

3. The portable table assembly of claim 2, wherein the second end portion of the elongate cylindrical stem has a forked configuration.

4. The portable table assembly of claim 3, wherein the forked configuration is trident shaped formed by a plurality of arms that include a main arm continuously formed on and extending along the same, longitudinal axis as the main body of the elongate cylindrical stem, and two side arms that are spaced apart from but are laterally adjacent to the main body and main arm of the elongate cylindrical stem, with each side arm extending along a parallel axis relative to the longitudinal axis of the main body of the elongate cylindrical stem and in a direction away from the first end of the elongate cylindrical stem.

5. The portable table assembly of claim 4, wherein each arm of the plurality of arms of the forked configuration terminates with a pointed end configured to pierce a ground surface.

6. The portable table assembly of claim 5, wherein each side arm of the fork configuration is shorter than the main arm of the fork configuration to provide lateral stability to the portable table assembly when anchoring the elongate cylindrical stem into a ground surface.

7. The portable table assembly of claim 6, wherein utility hooks are positioned on the elongate cylindrical stem between the first and second end portions of the elongate cylindrical stem, with the utility hooks being more proximate to the first end portion than the second end portion of the elongate cylindrical stem.

8. A portable table assembly comprising:

(a) a table top having an upper planar surface for placing items thereon:

(b) an elongate cylindrical stem having a first end portion and a second end portion that are spaced apart from one another with first end portion configured to securely fasten the table top thereon and the second end portion configured to stably anchor the portable table assembly into a ground surface; and (c) a fastening arrangement that securely and removably fastens the table top to the first end portion of the elongate cylindrical stem thereby preventing rotation of the table top about a longitudinal axis of the elongate cylindrical stem, wherein:

the table top includes an opening positioned in a middle of the table top that is adapted to axially align with and receive a distal end of the elongate cylindrical stem therethrough such that portions of the first end portion of the elongate cylindrical stem extend above and below upper and lower planar surfaces of the table top; and the fastening arrangement includes a mounting bracket affixed to a bottom planar surface of the table top, the mounting bracket includes a hollow cylindrical stem with arcuate grooves formed thereon, with the hollow cylindrical stem adapted to fit over the first end portion of the elongate cylindrical stem with the arcuate grooves engaging utility hooks positioned on the elongate cylindrical stem to prevent rotational movement of the table top about the longitudinal axis of the elongate cylindrical stem.

9. The portable table assembly of claim 8, further comprising a fastener positioned in an opening of the hollow cylindrical stem that is configured to urge the elongate cylindrical stem in a direction of an inner wall of the hollow cylindrical stem opposite the opening to affix the position of the elongate cylindrical stem relative to the hollow cylindrical stem and table top.

10. The portable table assembly of claim 9, further comprising a driving member that is proximate to the second end portion and includes a lip configured for a user to apply downward force thereto to anchor the elongate cylindrical stem into a ground surface.

* * * * *